United States Patent [19]

Tomlinson

[11] Patent Number: 4,635,843

[45] Date of Patent: Jan. 13, 1987

[54] DISPOSABLE UTENSIL

[76] Inventor: Barnard E. Tomlinson, 913 Emma, Walla Walla, Wash. 99362

[21] Appl. No.: 796,612

[22] Filed: Nov. 8, 1985

[51] Int. Cl.[4] ..... B65D 5/46

[52] U.S. Cl. ..... 229/52 B; 229/171; 229/195; 294/55

[58] Field of Search ..... 15/257.1; 30/142; 229/23 BT, 52 B, 171, 195, 197; 294/55; 493/59, 88, 137, 162, 909, 964, 968

[56] References Cited

U.S. PATENT DOCUMENTS 636,735 11/1899 Davenport ..... 294/55

3,746,240 7/1973 Flynn ..... 229/52 B 3,776,108 12/1973 Nock ..... 229/52 B

*Primary Examiner*—E. R. Kazenske

*Assistant Examiner*—Michael D. Folkerts

*Attorney, Agent, or Firm*—Seed and Berry

[57] ABSTRACT

A disposable utensil is made from a cardboard blank and takes the form of a flat-bottomed hand scoop with forwardly sloped side walls, a back wall, and a pair of rear handles. The back wall is overlapped by a reinforcing wall which is in turn overlapped by a panel from which the handles extend and which is connected at the top to the back wall and at the bottom to the reinforcing wall.

14 Claims, 3 Drawing Figures

DISPOSABLE UTENSIL

TECHNICAL FIELD

The present invention relates to a disposable utensil made from a cardboard blank and is intended for use, for example, in holding a slice of pizza while it is being eaten.

BACKGROUND ART

Hand holding and eating a slice of pizza can be a messy affair. The present invention aims to provide an inexpensive disposable utensil which can be conveniently used to serve a slice of pizza and hold it while it is being eaten. The invention is also applicable to serving and eating other food.

DISCLOSURE OF INVENTION

The preferred embodiment of the invention takes the form of a flat-bottomed hand scoop with a rear handle which can be slid under a pizza slice to capture it for eating. The pizza is then eaten by gently biting into the front of the slice, pulling the slice forward so that it projects partway beyond the utensil, and then biting off a piece of the projecting portion. In accordance with the present invention, the utensil is made from a die cut cardboard blank which is easily folded into the form of a scoop having a flat bottom wall, two forwardly sloped side walls, and a back wall. The back wall has locking tabs at its ends for interfitting with slots in the side walls and has a handle carrying extension panel which folds down at the rear. This extension panel has a pair of fold-out handles at its ends and a reinforcing panel at its rear which duplicates the back panel and also has locking tabs. The reinforcing panel doubles under the handle carrying panel to a position between the back panel and the handle carrying panel, and the tabs at the ends of the reinforcing panel overlap the locking tabs of the back panel and also extend through the slots in the side panels to interlock with the side panels. Thus erection is simple and the utensil is very inexpensive to produce.

BEST MODE FOR CARRYING OUT THE INVENTION

Figure 1:
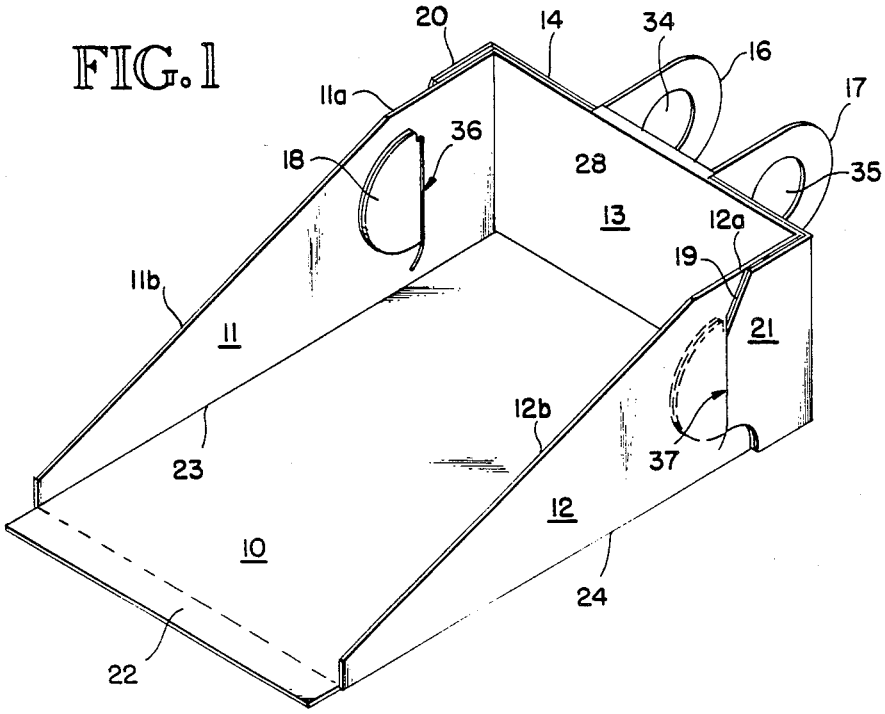
FIG. 1 is a perspective view of a utensil made in accordance with the invention.
Figure 2:
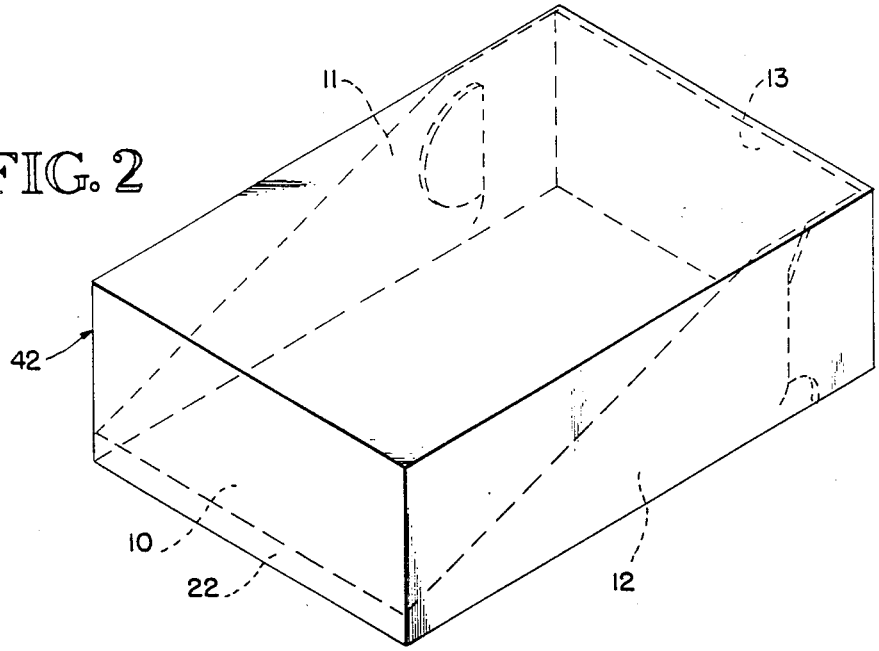
FIG. 2 is a perspective view of the utensil with a cover applied.
Figure 3:
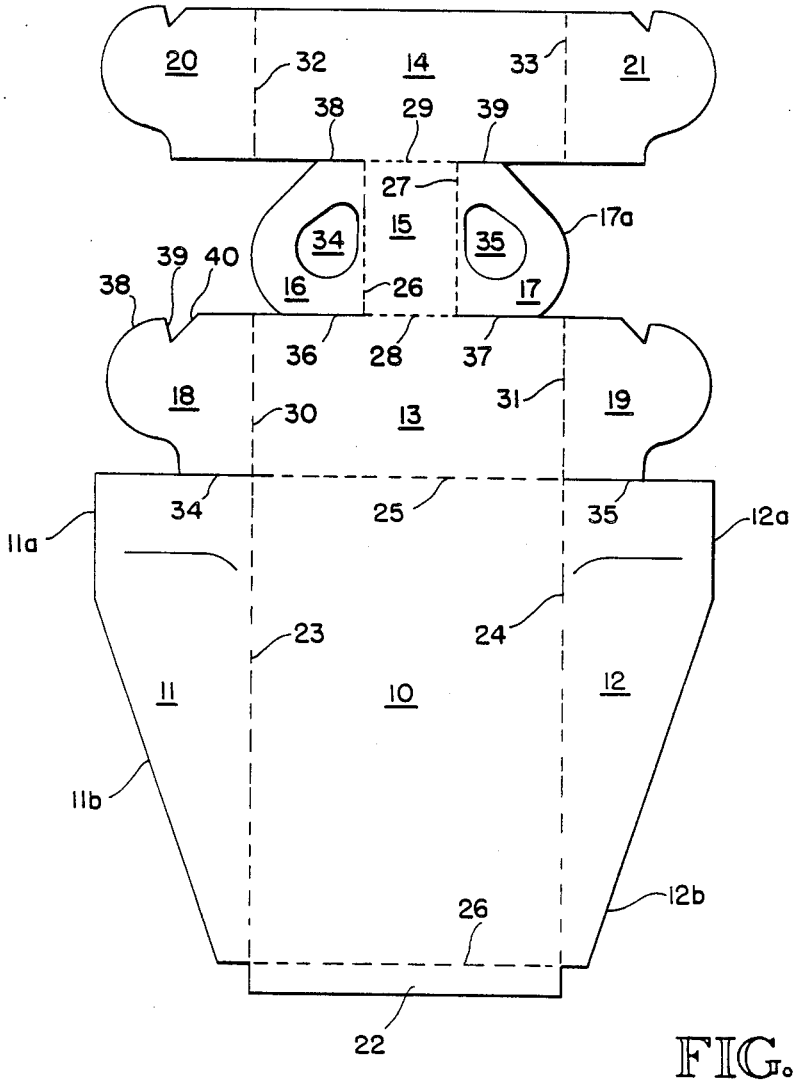
FIG. 3 is a plan view of a blank for the utensil.

Referring to the layout of the blank for the utensil (FIG. 2), it is seen that the blank is symmetrical from left to right. Accordingly, the same identifying numerals will be applied to like cuts and fold lines on both sides of the longitudinal center line. The lower end of the blank, as appearing in FIG. 2, will hereinafter be designated as the front of the utensil.

Basically, the utensil has a rectangular base panel 10, a pair of side panels 11–12, a rectangular back panel 13, a rectangular reinforcing panel 14, a rectangular handle carrying panel 15, a pair of handles 16–17, two pairs of locking tabs 18–19 and 20–21, and a front lip 22. The blank for the utensil is die cut from a sheet of cardboard and indented to define four fold lines 23 through 26 outlining the base panel 10, four fold lines 26 through 29 outlining the handle carrying panel 15, a pair of fold lines 30–31 defining the side edges of the back panel 13, and a pair of fold lines 32–33 defining the side edges of the rear reinforcing panel 14. During the cutting operation, the following linear cut lines are made: cut lines 34–35 separating locking tabs 18–19 from the back edges of side panels 11–12, and cut lines 36–37 and 38–39 separating handles 16–17 from the back panel 13 and rear reinforcing panel 14. Also formed are gripping cutouts 34–35 in the handles 16–17 and locking slots 36–37 in the side panels 11–12. These slots have a straight portion **36*a*–37*a* which preferably terminates by a forwardly directed curved portion 36*b*–37*b***.

The two pairs of locking tabs 18–19 and 20–21 have the same shape; each tab is formed with a rounded hook portion at its free end having a beak 38 with a locking edge 39 defined by a V-shaped cutout 40 (see tab 18).

The handles 16–17 preferably have rounded outer edges **16*a*–17*a* and have their cutouts 34–35** of similar shape. These cutouts are preferably of a size adequate to receive a thumb and forefinger.

To assemble the utensil from the blank, the two side panels 11–12 and the back panel 13 are bent upwardly along the fold lines 23, 24 and 25, respectively. Then locking tabs 18–19 are folded forwardly in outer overlapping relation to side panels 11–12, and the beak portions 38 of the locking tabs are passed forwardly through the locking slots 36–37 to bring the apex of the cutouts 40 into registry with the upper ends of the slots 36–37. This makes a locking interfit between the beaks 38 of the tabs 18–19 and the portions of the side panels 11–12 between the upper ends of the slots 36–37 and the rear upper edge portions **11*a*–12*a* of the side panels. From these upper edge portions 11*a*–12*a*, the side panels preferably slope downwardly by sloped edge portions 11*b*–12*b***.

After the locking tabs 18–19 have been locked into position, the rear reinforcing panel 14 is folded downwardly along fold line 29 and doubled under handle carrying panel 15 and handles 16–17 so that the under face of panel 14 engages the under face of panel 15 and handles 16–17. Then the handle carrying panel 15 and underlying reinforcing panel 14 are folded down as a unit behind back panel 13. This locates the reinforcing panel 14 between the handle carrying panel 15 and the back panel 13, and positions the locking tabs 20–21 projecting laterally at the rear of the side panels 11–12. Next, the locking tabs 20–21 are bent forwardly along fold lines 32–33 and are inserted from the outside through the slots 36–37 in overlapping relation to the locking tabs 18–19 and into locking interfit with the side panels 11–12 in the same manner as previously described for locking tabs 18–19. Finally, the handles 16–17 are bent rearwardly at fold lines 26–27. The front lip 22 can be tilted downwardly along fold line 26 relative to the base panel 10 if desired.

An alternate erection procedure is to first double the reinforcing panel 14 beneath the handle carrying panel 15 and handles 16–17, and then fold panels 14–15 as a unit beneath the back panel 13. This locates the locking tabs 18–19 in overlapping relation to locking tabs 20–21. Then the side panels 11–12 are folded upwardly along fold lines 23–24; and the back panel 13, reinforcing panel 14 and handle carrying panel 15 are folded upwardly as a unit along fold line 25. This positions overlapping locking tabs 18–19 and 20–21 in laterally projecting position, and they then can be bent forwardly along fold lines 30–31 and 32–33 and inserted together through the locking slots 36–37.

The assembled utensil has the general appearance of a scoop with a pair of rearwardly extending handles. When used by a right-handed person, for example, the handles 16–17 may be gripped by bending the handles toward one another with the forefinger in cutout 34 and the thumb in cutout 35.

A rectangular cover 42 may be readily applied to the utensil after folding the handles 16–17 flat against the rear face of the reinforcing panel 14 and folding the lip 22 upwardly along fold line 26.

If desired, the fold lines 23–24 between the base panel 10 and the side panels 11–12 may diverge slightly from the back edge 25 of the base panel so that the utensils may be stacked after being formed from the blanks.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A cardboard blank for making a utensil, comprising:

a base panel having a pair of side edges and a rear edge defined by fold lines;

a pair of side panels and a rectangular back panel joined to said side edges and rear edge of the base panel, said back panel having a back edge and a pair of side edges defined by fold lines;

a rectangular handle carrying panel connected to the back panel at the back edge of the back panel and having a back edge and a pair of side edges defined by fold lines;

a rectangular reinforcing panel matching the back panel and connected to the handle carrying panel at the back edge of the latter, said reinforcing panel having side edges defined by fold lines;

a first pair of locking tabs connected to the back panel at the side edges thereof;

a second pair of locking tabs matching said first pair and connected to the reinforcing panel at the side edges thereof;

a pair of handles connected to the handle carrying panel at the side edges thereof, said handles being located between and separated from the back panel and the reinforcing panel; and a pair of slots in the side panels for receiving said pairs of locking tabs.

2. A utensil comprising:

a base panel having a rear edge and two longitudinal side edges extending forwardly from the ends of the rear edge;

an upstanding back panel and a pair of upstanding side panels joining the base panel at the rear edge and the two side edges, respectively;

a handle carrying panel connected to the top edge of the back panel and having a bottom edge;

a reinforcing panel connected to the bottom edge of the handle carrying panel and positioned between the handle carrying panel and the back panel;

two opposed locking slots in the rear portion of the side panels and extending generally in a vertical direction;

two forwardly directed locking tabs connected to the back panel;

two forwardly directed locking tabs connected to the reinforcing panel and overlapping the other two locking tabs to form a pair of overlapping locking tabs at each side, said two overlapping pairs of locking tabs extending through said locking slots and interfitting with the side panels; and a pair of rear handles connected to the handle carrying panel.

3. A utensil according to claim 2 in which said panels, locking tabs, and handles are formed from a single sheet of cardboard, and the connections between the base panel and pair of side panels and back panel, the connections between the handle carrying panel and the back panel and reinforcing panel, the connections between the tabs and the back panel and reinforcing panel, and the connections between the handles and the handle carrying panel, are along respective fold lines in the cardboard sheet.

4. A utensil according to claim 2 in which each of said locking tabs has a rounded forward edge and has a cutout at the top forming a locking edge interlocking with the side panels at the top of the locking slots.

5. A utensil according to claim 2 in which said handles are connected to the handle carrying panel along vertical fold lines and have cutouts for gripping.

6. A utensil according to claim 2 in which said base panel has a front lip projecting forwardly of the side panels.

7. A utensil according to claim 6 in which said front lip is folded upwardly from the base panel, and a cover fits over the outside faces of the back panel, side panels and lip.

8. A utensil according to claim 2 in which a cover fits over the outside faces of the back panel and side panels.

9. A utensil according to claim 2 in which said locking slots curve forwardly at their bottom ends.

10. A utensil according to claim 2 in which said back panel, handle carrying panel and reinforcing panel are rectangular and substantially the same height.

11. A utensil according to claim 10 in which said side panels have forwardly sloping upper edge portions.

12. A utensil according to claim 10 in which said base panel is generally rectangular and has a forwardly projecting rectangular lip at the front.

13. A utensil according to claim 2 in which the reinforcing panel is the same size and shape as the back panel.

14. A utensil according to claim 13 in which the locking tabs have the same size and shape.

* * * * *